United States Patent [19]

Peterson et al.

[11] 4,017,308

[45] Apr. 12, 1977

[54] SMELTING AND REDUCTION OF OXIDIC AND SULPHATED LEAD MATERIAL

[75] Inventors: Stig Arvid Peterson; Sven Anders Lundquist, both of Skelleftehamn, Sweden

[73] Assignee: Boliden Aktiebolag, Stockholm, Sweden

[22] Filed: Dec. 12, 1974

[21] Appl. No.: 532,233

[30] Foreign Application Priority Data

Dec. 20, 1973 Sweden ..... 7317217
Dec. 20, 1973 Sweden ..... 73172181

[52] U.S. Cl. ..... 75/77
[51] Int. Cl.[2] ..... C22B 13/00
[58] Field of Search ..... 75/77, 78, 93 R; 266/37

[56] References Cited

UNITED STATES PATENTS

| | | | |
|---|---|---|---|
| 1,844,428 | 2/1932 | Kohlmeyer | 75/77 |
| 3,243,283 | 3/1966 | Lumsden | 75/77 |
| 3,756,806 | 9/1973 | Hathorn | 75/93 R |

OTHER PUBLICATIONS

Boldt Jr., Winning of Nickel, TN490N6B6, Van Nostrand Co. Inc., 1972, p. 252.

*Primary Examiner*—M. J. Andrews
*Attorney, Agent, or Firm*—Stevens, Davis, Miller & Mosher

[57] ABSTRACT

Processes are provided for the recovering of crude lead from materials containing lead substantially in the form of oxides and/or sulphates. The processes are carried out in a rotary converter with the rotation axis inclined to the plane of the vertical. In the process the materials containing lead are smelted and reduced while the furnace is rotated. Processes are also provided to separate and recover possible impurities of arsenic, antimony and tin.

12 Claims, 1 Drawing Figure

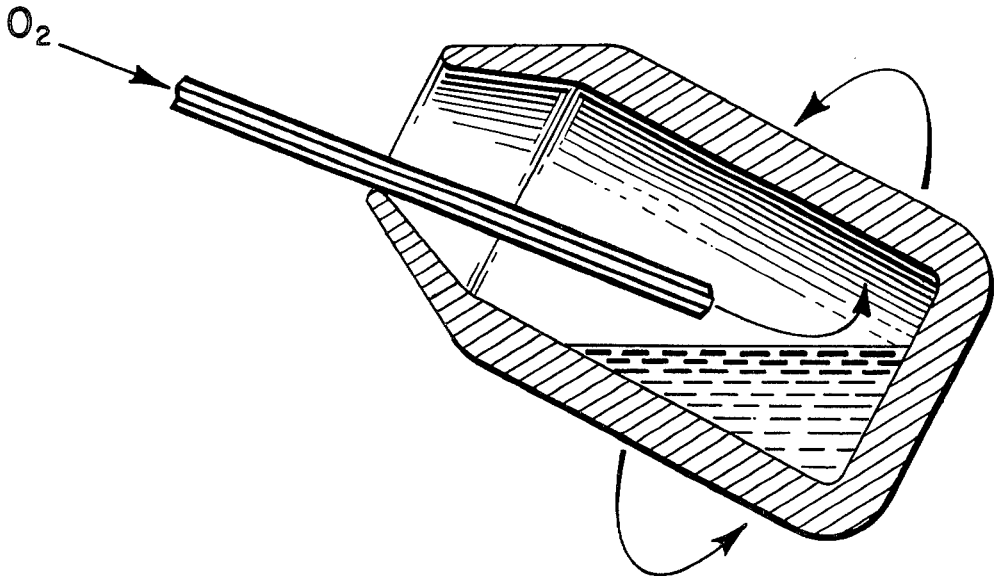
$O_2$

SMELTING AND REDUCTION OF OXIDIC AND SULPHATED LEAD MATERIAL

The invention refers to a method of producing crude lead from material containing lead substantially in the form of oxides and sulphates obtained in the metallurgical treatment of lead, zinc and/or complex copper concentrates. The method is also suitable for the working up of accumulator scrap and similar material. Oxidic and sulphated intermediate products of this type are largely dust products which are collected in dust filters of various kinds, for example, tubular filters, bag filters or electrostatic precipitators. Such intermediate products are in general very complex and usually largely consist of oxides and/or sulphates of Pb, Cu, Ni, Bi, Cd, Sn, As, Zn and Sb. In certain cases precious metals can also be present in valuable quantities. The halogens such as chlorine and fluorine are usually also present. The composition usually varies within wide limits and it is therefore not possible to state the composition of typical material but the lead content ought to be over 20% if the material is to be used for the economic production of lead. How low the lead content can be and still make the treatment economic naturally depends on the value of other metals present, above all tin and the precious metals. Intermediate products of the type mentioned are formed in large quantities in non-ferrous metallurgy and are invariably of considerable metallic value.

In practice, however, it has proved to be very difficult to extract the valuable metals from the material mentioned in an efficient and economic way. A number of processes have been tested but to date no economically attractive process has emerged.

Attempts have been made to smelt and reduce the metals in the above-mentioned complex products in the shaft furnaces normally used for the production of lead by mixing them with other furnace charges consisting of sintered lead concentrates, a slagging material and coke. Since the intermediate products nearly always contain considerable quantities of halogens such as chlorine and fluorine, easily fusible halogenides are formed which block the shaft and lead to the shutting down of the furnace.

Other ways of solving the problem of improving the above-mentioned products containing lead have therefore been tried. For a long time the intermediate products have been treated in reverbatory furnaces which was an advance on treating them in shaft furnaces. The reverbatory furnaces consist of a large hearth where the furnace charge is smelted with the aid of an air-fuel flame directed against the surface of the bath, whereby the metals are reduced by the coke mixed with the furnace charge. Reverbatory furnaces are not economical mainly because reduction takes place relatively slowly and by the fact that heat transmission is poor. In addition there are great dust losses.

To improve these conditions and rectify the irregularities in the above processes several types of rotary furnaces, have been tried. Rotary furnaces which are well-known and which have been described in the literature e.g. "Metall und Erz", volume 32, pp. 38 and 40 (1935). At first, furnaces with great length in relation to the diameter were used but this subsequently proved to be a source of difficulty. New types of furnace considerably shorter in relation to the diameter were therefore developed. Furnaces of this type are described in "Metall und Erz", volume 32, p. 511 ff (1935) and where the German name "Kurztrommelofen" ("short drum furnace") is generally adapted. Such furnaces are characterized by the fact that the diameter is approximately equal to the length and they are used, for example, in smelting and reducing accumulator scrap. One advantage of rotary furnaces is that there is no need to mix the charge in advance since mixing takes place with the rotation of the furnace normally at a rate of 1 rpm. Firing and smelting take place in the similar way to that used in reverbatory furnaces by means of a burner built-in into the end wall of the furnace. A difficulty with rotary furnaces is that they cannot be charged with material which is too finely divided since great dust losses occur in the rotation of the furnace. This depends on the fact that in the furnace there takes place such a slow reaction and smelting of the charged material that the unsmelted fine-grained material is entrained by the gas. In "Erz-metall" 1, pp. 21–28 (1948) a method of smelting and reducing intermediate products is described. The reduction of oxidic and sulphated material is effected in a slow rotating drum furnace by means of coke normally mixed with the material being introduced.

A disadvantage with the known slow rotating drum is that it is not possible to purify economically the reduced lead with respect to As, Sb and Sn, for instance. Lead produced in slow rotating furnaces, shaft furnaces and reverbatory furnaces will then contain these impurities if these are present in the raw material. In the production of lead refined in this way these metals must therefore be oxidized so that they can be removed in the form of slag. This must normally be done in a separate apparatus in the conventional way where crude lead refining is effected by allowing Sn, Sb and As to react with atmospheric oxygen to form oxides which float on the surface of the bath and which can be deslagged. Refining of this type can be carried out because of the fact that Sn, Sb and As have a greater affinity for oxygen than lead has.

In the above-mentioned slow rotating furnace method the said slagging can be effected by the use of an excess of air in the burner at a temperature of approx. 600°–900° C. This is however extremely time-consuming. The factor which determines the speed and selectivity of the refining is the diffusion of impurities to the surface of the metal bath where oxidation, in this case, takes place. The reaction surface between the metal and the reaction gas in the slow rotating furnace is very small. Using oxygen gas in the oxidation in slow rotating furnaces has been tried but this led to the oxidation of large quantities of lead irrespective of whether the oxygen was blown on to the surface or into the bath itself.

A development of the rotary furnace principle is the top blown rotary converter (TBRC) also called "Kaldo converter" which is characterized by its rapid rotation of up to 40 rpm and by the fact that it is mounted on bearings so that it in operation can rotate round an axis inclined towards the plane of the horizontal. This inclination should preferably be 15°–30°. Converters of this kind have been used in the steel industry for a long time. See, for example, SWP 137 382 and 162 036. These patents describe methods of decarburizing and refining pig-iron by blowing the surface with oxygen or oxygen-enriched air through a water-cooled lance with the converter rotating at the same time.

In recent years, rapid rotary converters have come into use in the reduction of sulphide material, e.g., in the production of copper and nickel. In this case the method involves smelting and reducing copper and nickel respectively and using oxygen or oxygen-enriched air to burn up sulphur by surface-blowing with a lance. See, for example 101st Annual Meeting AIME where Daniel and Jaquay describe methods of this type. The SWP 369 734 shows the treatment of converter slag with sulphides so as to purify the slag and thereby extract the copper content. See also SWP 355 603 which shows a method of producing copper by treating copper sulphide containing nickel. In general, it has often been the case that the advantages afforded by inclined rotary furnaces or converters, namely, faster reaction and large production in relation to the volume of the furnace, are often counteracted by high investment and running costs.

It has now surprisingly been shown that inclined rotary converters are extremely suitable for the production of crude lead by reduction of material containing lead in the form of oxides and/or sulphates possibly contaminated with one or more of the elements zinc, antimony, tin and arsenic. The lead material is smelted in this case by an oxygen-fuel flame in an inclined rotary converter after which the smelt is reduced to metallic lead with a reducing agent. At the same time tin, arsenic and antimony present in the material are also reduced to the elementary state. In the smelting and reduction process described above, considerable advantages are attained compared with earlier known processes. By virtue of the fact that the converter is inclined towards the plane of the vertical and that the number of revolutions can vary the friction force induced lifts smelt up along the inner wall of the converter to a level at which smelt falls as finely-divided drops of liquid. At maximum drop the converter will have an inclination of 15°–30° to the plane of the horizontal and a rotation of 10–60 rpm depending on the converter diameter. The furnace diameter can vary from 0.5–10 m and is preferably 2–4.5 m. The converter must be driven during the above mentioned reduction and refining at a speed of 0.5–7 m/s measured at the inner periphery of the cylindrical part of the converter. A preferred speed is 2–5 m/s. This will correspond to a 13–32 rpm for a converter with a diameter of 3 m. The above defined rotation gives a very thorough mixing of the charge so that the smelt is homogeneous with respect to its chemical composition and temperature. By dispersing the smelt in the gas phase in this way very rapid chemical reactions take place and equilibrium is quickly established. A good measure of control over the different variables in the reduction is thus obtained and it is easy to maintain the temperature within the required interval of 900° – 1250° C. Since some of the metal compounds in the charge are relatively volatile it is very important that the chemical reactions are rapid and particularly that there is close control over the temperature. The temperature can easily be kept within the desired interval by means of a burner using oil, gas or coal.

BRIEF DESCRIPTION OF THE DRAWING

The drawing shows a conventional inclined top blown rotating converter used in the present invention.

Dust problems always arise in metallurgical processes when particle materials are introduced into furnaces with burners and above all in those cases where the materials are very finely-divided. The drops of liquid smelt previously mentioned which are formed during the rotation of the converter contribute effectively to wetting the charged materials so that the proportion of dust entrained in the waste gases is very small. As opposed to conventional processes, this now makes possible the continuous charging of materials which consist wholly or partially of very fine fractions. This in turn allows considerable economic savings in the preparation of the charge. Intermediate products containing lead are usually obtained as very finely-divided dust. This dust can be directly smelted and reduced by the present method without any kind of advance pelletizing and/or sintering to larger agglomerates being necessary.

During the reduction, heat is mainly supplied by means of, for example, an oil-burner. The actual reduction of the smelt can be effected with the same burner with a reducing flame and/or solid reducing agent. Examples of solid reducing agents that can be used are iron or coke (coal) but even sulphides, e.g., lead concentrate (PbS) can be used. Lead sulphide reacts with lead(II) oxide and lead sulphate as follows:

$$PbS + 2\ PbO \longrightarrow 3\ Pb + So_2$$

$$PbS + PbSO_4 \longrightarrow 2Pb + 2\ SO_2$$

$$PbS + 2\ PbO.PbSO_4 \longrightarrow 7\ Pb + 5\ SO_2$$

Lead concentrates can be used in both agglomerated and non-agglomerated form.

From the reduction is obtained a crude lead containing the impurities of the raw material in the form of tin, arsenic, antimony, bismuth and cadmium. From the zinc oxide in the charge, on the other hand, there is formed a slag, since zinc is reduced at a very low level of oxygen activity in the oxidic slag which covers the lead bath. If the reduction is driven so far that the content of lead oxide in the slag falls to below approx. 5%, zinc also begins to be reduced and on account of its volatility is expelled.

The zinc oxide which is formed and which floats on the lead bath is not smelted at the prevailing temperatures which is why a liquid slag containing zinc is obtained when a slagging material such as fayalite and/or quartz sand is added. This slag can be tapped and will then contain approximately 5% PbO whereby zinc fuming is avoided. The slag can then be treated in a special slag-fuming furnace for the recovery of the zinc. The method thus allows different ways of recovering the zinc depending on actual conditions. In conventional reduction methods using reverbatory furnaces or horizontally slow rotating furnaces, for example the "Kurztrommelofen", the reduction is effected very slowly. This depends partially on the fact that the contact between the reducing agent and the smelt is poor.

Another way of solving this problem is to continue the reduction of lead oxide to a content of 1 – 2% PbO in the slag whereby considerable quantities of zinc will be produced and volatilized. The volatilized zinc can after oxidation to zinc oxide be recovered in a gas purification plant constructed of tubular filters or electrostatic precipitators.

It has also been shown that TBRC converters are very suitable for the through-removal of antimony, tin and arsenic from the lead produced by oxygen, and then firstly removing an oxidic slag containing tin, then oxidic slags containing arsenic and antimony.

After the above-mentioned smelting and reduction where slag containing zinc is tapped or expelled, refining of the crude lead is carried out by blowing oxygen or oxygen-enriched air into the rotary converter by means of a lance directed 10–50 cm above at the surface of the bath. Sn, As and Sb impurities in the lead smelt thereby react with the oxygen to form oxides which float to the surface of the bath whence they can be slagged off. It has surprisingly been shown that this purification of the lead can be carried out with excellent selectivity regarding $SnO_2$ on the one hand and As and Sb on the other. The explanation for this lies not only in the fact that metals mentioned have different affinities for oxygen but also in the fact that the process described creates such conditions that the said purification selectivity is attained.

As shown in the FIGURE, oxygen or an oxygen-containing gas is passed into the top of the inclined rotating converter and contacts the surface of the bath.

The present invention gives a production capacity which is 8–10 times greater than earlier known lead processes. Oxygen can be used in the process if desired and this has the great advantage of reducing the quantity of exhaust gases and thereby facilitating gas purification and reducing the amount of dust entrained by the gases. In addition the reduced lead can be purified selectively in the same furnace unit rapidly and economically, an operation that is not possible in reverbatory or rotating horizontally furnaces, for example the "Kurztrommelofen".

A process according to the present invention is impossible to carry out in, for example, reverbatory furnaces or horizontally slow rotating furnaces.

EXAMPLE 1

In the execution of the method in accordance with the present example a TBRC with a diameter of 3.6 m and an effective volume of 10 $m^3$ is used. The converter was provided with auxiliary equipment amongst which can be mentioned feeding conveyor and charging bins above the converter for pellets, coke and sand and an intermediate charging bin for mixed materials.

The converter was charged with 21 ton material consisting of:

| | |
|---|---|
| 43–7% Pb | 4.8% Fe |
| 8.9% Zn | 5.0% $SiO_2$ |
| 0.55% Sn | 0.56% Cd |
| 3.7% As | 3.4% Cl |
| 0.35% Sb | 1.5% F |
| 0.04% Bi | 5.9% S |
| 0.06% Cu | 4.7% $H_2O$ |

The charging time was 10.5 min.

The converter was fitted with a burner to which 15 l oil and 35 $Nm^3$ oxygen per minute were fed. The smelting took 74 min after which the converter was raised and a further 15 ton material was added and smelted, this taking 53 min. This was repeated with an additional 15 ton material which was smelted after 53 min. The converter then contained 51 ton smelted material and the total length of time required to reach completion for the smelting was 205.5 min 2.7 $m^3$ oil and 6 300 $Nm^3$ oxygen had been supplied through the burner. During the initial stage of the smelting-down, the furnace was rotated only slowly (about 1 rpm) and when the smelting began to reach completion the furnace was rotated at a speed of up to 20 rpm.

The reduction which then followed was achieved by the use of coke at a rate of about 40 kg per ton charge or 2040 kg for the whole batch. The reduction time was 180 min and the heat was maintained by means of a somewhat reducing fuel flame to which were added 4 l oil and 8 $Nm^3$ oxygen per minute. The rotation speed of the converter was increased during the reduction time successively up to 25 rpm, whereby a powerful "rain" of drops of liquid was obtained in the converter. The process was terminated by a gradual reduction of the coke supply and the speed of rotation. The converter now contained a crude lead to a quantity of 19 ton and following analysis: Sn 0.86%, As 1.26%, Sb 0.63% and which could be further treated metallurgically or cast into ingots.

EXAMPLE 2

After removal of the slag the crude lead from example 1 in a quantity of 19 ton was further refined for the removing and recovery of Sn, Sb, and As.

The converter was rotated at a speed of approx. 25 rpm and the oxidation was effected by means of oxygen blown into the hearth with the aid of an oxygen lance at a rate of approx. 10 $Nm^3$/min for approx. 8.5 min, whereby all the tin was oxidized together with some lead. The slag containing tin which was removed had the following analysis: Pb = 50%, Sn = 20%. Oxygen efficiency in the oxidation of the tin was approx. 80%, the remaining oxygen forming lead oxide. The total consumption of oxygen was 85 $Nm^3$.

After tin slagging and its subsequent removal the arsenic and antimony present in the crude lead were oxidized in the same way by further oxidation. The As-Sb-Pb slag formed in the oxidation, approx. 1 ton was removed after the completion of the oxidation. It had the following analysis: As = 25%, Sb = 13%, Pb = 60%. In this case also the efficiency was approx. 80%, giving a total oxygen consumption of 120 $Nm^3$.

The contents of tin, arsenic and antimony in the purified lead were: Sn<0.003%, As<0.003% and Sb<0.003%.

Considering the difficulties that generally arise with the slow reaction processes which normally characterize lead reduction, it was thus completely surprising that the process could be effected in an inclined, rotary converter and that by the reaction between the drops of liquid and reactive gas a so unexpectedly large capacity per $m^3$ furnace volume could be obtained.

We claim:

1. The method of recovering crude lead from materials containing lead substantially in the form of oxides and/or sulfates comprising charging said materials into a top blown rotary converter with an inclined rotational axis, smelting said materials with the aid of a flame formed by burning fuel with oxygen over the surface of the bath of smelted material, rotating the top blown rotary converter at 10–60 r p m and at a speed of 0.5 – 7 m/s measured at the inner periphery of the cylindrical part of the converter and with said rotational axis inclined to the horizontal plane so that the smelted material by means of the friction force induced by the rotational speed is lifted up along said inner periphery of the converter to a level at which smelt falls as finely-divided drops of liquid, reducing oxides and/or sulfates of lead present in said smelted material during said rotation by introducing a reducing agent, and thereafter tapping any slag formed and crude lead smelt from the converter.

2. The method according to claim 1, wherein said speed 2 – 5 m/s.

3. The method according to claim 1 in which a material containing lead obtained as intermediate products in the pyrometallurgical treatment of complex minerals contaning lead, zinc and/or copper is used.

4. The method according to claim 3, in which the material is obtained as dust from a lead smelting furnace.

5. The method according to claim 3, in which the material contains at least 20% by weight lead.

6. The method according to claim 1, in which said reducing agent is selected from the group consisting of carbon, metal sulphides, hydrogen, carbon monoxide and metallic iron.

7. The method according to claim 1, in which coal, oil, natural gas or pyrites are used as fuel.

8. The method according to claim 1, in which the reduction of the material is allowed to continue until the content of the lead oxide remaining in the slag is 5% by weight and that dust formed is returned to the converter.

9. The method according to claim 3, in which the reduction of the lead continues to a level less than 5% by weight lead oxide after which zinc compounds in the slag are reduced and vaporized and that the gas formed is separated in a gas purification system out of which materials containing zinc can be recovered.

10. The method according to claim 1, in which the material containing lead is accumulator scrap.

11. The method according to claim 1, in which the temperature during the smelting is maintained between 900° – 1250° C.

12. The method according to claim 1 wherein the top blown rotary converter is inclined 15° to 30° to the horizontal plane.

* * * * *